US006375293B1

(12) United States Patent
Endo

(10) Patent No.: US 6,375,293 B1
(45) **Date of Patent: *Apr. 23, 2002**

(54) PRINTING METHOD AND APPARATUS, PRINTED MATTER OBTAINED THEREBY AND PROCESSED ARTICLE OBTAINED FROM THE PRINTED MATTER

(75) Inventor: Hiroshi Endo, Sagamihara (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/235,799

(22) Filed: Apr. 29, 1994

(30) Foreign Application Priority Data

May 13, 1993 (JP) ..... 5-111477

(51) Int. Cl.[7] ..... B41J 3/00
(52) U.S. Cl. ..... 347/2
(58) Field of Search ..... 346/134, 136, 346/83; 347/101, 104, 107, 105, 106, 2, 3, 174, 177, 218, 4, 19; 400/582, 583.3, 630, 706, 708; 235/449, 454, 462, 468; B41J 11/46

(56) References Cited

U.S. PATENT DOCUMENTS

| | | | | | |
|---|---|---|---|---|---|
| 3,913,719 | A | * | 10/1975 | Frey | 101/91 |
| 4,313,124 | A | | 1/1982 | Hara | 347/57 |
| 4,345,262 | A | | 8/1982 | Shirato et al. | 347/57 |
| 4,423,676 | A | * | 1/1984 | Neel | 101/211 |
| 4,459,600 | A | | 7/1984 | Sato et al. | 347/56 |
| 4,463,359 | A | | 7/1984 | Ayata et al. | 347/56 |
| 4,464,203 | A | * | 8/1984 | Belde et al. | 106/432 |
| 4,552,065 | A | * | 11/1985 | Billington et al. | 400/583.3 X |
| 4,558,333 | A | | 12/1985 | Sugitani et al. | 347/65 |
| 4,567,357 | A | | 1/1986 | Fedele | 235/377 |
| 4,590,490 | A | * | 5/1986 | Takanashi et al. | 347/177 |
| 4,608,577 | A | | 8/1986 | Hori | 347/66 |
| 4,684,276 | A | * | 8/1987 | Frei et al. | 400/630 |
| 4,723,129 | A | | 2/1988 | Endo et al. | 347/56 |
| 4,725,849 | A | * | 2/1988 | Koike et al. | 347/107 X |
| 4,740,796 | A | | 4/1988 | Endo et al. | 347/56 |
| 4,788,563 | A | * | 11/1988 | Omo et al. | 358/75 |

FOREIGN PATENT DOCUMENTS

| | | | |
|---|---|---|---|
| EP | 0128858 | 12/1984 | |
| EP | 0398515 | 11/1990 | |
| EP | 0430678 | 6/1991 | |
| GB | 2229677 | * 10/1990 | B41J/11/46 |
| JP | 54056847 | 5/1979 | |
| JP | 59101966 | 6/1984 | |
| JP | 59123670 | 7/1984 | |
| JP | 59138461 | 8/1984 | |
| JP | 60071260 | 4/1985 | |
| JP | 60145865 | 8/1985 | |
| JP | 62087376 | 4/1987 | |
| JP | 63172673 | 7/1988 | |
| JP | 116659 | 1/1989 | |
| JP | 5-31966 | 2/1993 | |

* cited by examiner

*Primary Examiner*—Judy Nguyen
(74) *Attorney, Agent, or Firm*—Fitzpatrick, Cella, Harper & Scinto

(57) ABSTRACT

A printing system for performing printing on a print medium includes a printer for printing an image at a position in accordance with a mark printed on the print medium by screen printing, and an ink-jet printer for discharging ink to print an image on the print medium. The ink-jet printer includes a detector for detecting the mark printed on the print medium. The ink-jet printer prints a corresponding image of the image printed by the printer based on a position of the mark detected by the detector.

18 Claims, 15 Drawing Sheets

FIG.10

| PALETTE DATA | CYAN | MAGENTA | YELLOW | BLACK | S1 | S2 |
|---|---|---|---|---|---|---|
| 0 | 10 | 10 | 10 | 0 | 0 | 0 |
| 1 | 0 | 0 | 0 | 0 | 255 | 0 |
| 2 | 0 | 0 | 0 | 0 | 0 | 255 |
| 3 | 150 | 150 | 0 | 0 | 0 | 0 |
| 4 | 0 | 0 | 0 | 255 | 0 | 0 |
| 5 | 0 | 200 | 200 | 0 | 0 | 0 |
| 6 | 0 | 250 | 100 | 0 | 0 | 0 |
| ⋮ | ⋮ | ⋮ | ⋮ | ⋮ | ⋮ | ⋮ |
| 254 | 0 | 0 | 255 | 0 | 0 | 0 |
| 255 | 0 | 0 | 0 | 0 | 0 | 0 |

PRINTING METHOD AND APPARATUS, PRINTED MATTER OBTAINED THEREBY AND PROCESSED ARTICLE OBTAINED FROM THE PRINTED MATTER

BACKGROUND OF THE INVENTION

1. Field of the Invention

This invention relates to a printing method and apparatus for performing printing through a sequential method by scanning a plurality of printing heads, as well as to printed matter obtained by this printing method and a processed article obtained by working the printed matter.

2. Description of the Related Art

Conventional textile printing methods for printing on fabrics or textiles mainly are of two types, namely roller textile printing in which a pattern is engraved in a roller and the roller is pressed against a cloth to produce a continuous design, and screen textile printing in which a printing plate is fabricated into the shape of a screen and the number of screen plates used corresponds to the number of colors desired to be superimposed and the number of patterns desired to be overlapped. A printing apparatus which has been put into practical use as a substitute for these methods applies an ink-jet printing system to cloth.

A printer and a copying apparatus employing paper as the printing medium are known as printing apparatus that perform ink-jet printing. Such a printing apparatus jets a plurality of inks of the primary colors in the form of a dot matrix on the printing medium so that it is possible to express a diversity of colors by mixing colors, wherein the colors are mixed by arranging or superposing dots. This makes it possible to provide an entirely new design environment. Since the apparatus produces little noise, the effects upon the surroundings are reduced. In addition, the apparatus is capable of revolutionizing the manufacturing site. For these reasons, the aforementioned printing apparatus has become the focus of much attention.

However, certain problems arise when cloth is adopted as the printing medium. Specifically, the term "cloth" includes not only natural fibers such as cotton, silk and fur but also synthetic fibers such as nylon, polyester and acrylic fiber. Various technical difficulties arise depending upon the type of printing medium, example of which are as mentioned.

In techniques for printing on cloth using the conventional ink-jet method, textile printing is carried out by jetting the ink in the form of droplets and causing the ink to attach itself to the cloth in the form of a dot matrix. As a consequence, the following drawbacks arise:

(1) When the same color is printed uniformly, the printed image develops stripes and other irregularities owing to uneven jetting of the ink from each nozzle of the ink-jet head. This invites a decline in picture quality and can lead to a decline in the commercial value of the printed product or even complete loss of commercial value.

(2) In a case where the amount of ink necessary for dying is greater than that jetted from the ink-jet head, defects such as a decline in color density or undyed portions in the gaps between fibers can occur, depending upon the type of cloth.

(3) When a case in which the printing ink is monochromatic and a case in which a inks of a plurality of colors are mixed are compared, it is found that the absolute amount of ink jetted onto the cloth from the head in the former is less, depending upon the color. This can result in defects such as a decline in color density or undyed portions in the gaps between fibers.

(4) In textile printing on cloth, generally the entire area of the cloth is dyed, as a result of which an enormous amount of ink is jetted from the head. This means that the ink-jet head performs a large number of ink jetting operations. Consequently, head lifetime is shortened, many heads must be used and the heads must be replaced a large number of times. The end result is higher running cost and more troublesome maintenance.

Further, if the amount of ink that attaches itself at the proximity of the nozzle jetting ports becomes large in proportion to the amount of ink jetted from the nozzle, a cleaning operation is necessary to remove the attached ink. This results in reduced printing speed overall.

SUMMARY OF THE INVENTION

Accordingly, an object of the present invention is to provide a printing method and apparatus of a higher picture quality, in which improvements are made in terms of printing speed, maintenance and running cost.

Another object of the present invention is to provide a printing method and apparatus in which marks that are used for positioning of an image printed in another printing process, are printed using ink having a very low light resistance and the marks are erased by irradiating with light at the end of the printing process, thereby making it possible to perform printing while eliminating effects upon the printing image.

Another object of the present invention is to provide a printing method and apparatus in which marks that are used for positioning of an image printed in another printing process, are printed using ink having a very low heat resistance and the marks are erased by heating at the end of the printing process, thereby making it possible to perform printing while eliminating effects upon the printing image.

A further object of the present invention is to provide a printing method and apparatus, in which a textile printing portion of a uniform single color is printed by a method other than the ink-jet method, thereby improving picture quality, as well as printed matter obtained by using the method and apparatus and a processed article obtained using the printed matter.

A further object of the present invention is to provide a printing method and apparatus through which it is possible to compensate for a decline in printed color density and insufficient dyeing in case of a cloth having a high ink absorbency or when dying is performed using a monochromatic ink, where the absolute amount of ink tends to be insufficient.

Yet another object of the present invention is to provide a printing method and apparatus through which the lifetime of an ink-jet head can be prolonged by lightening the textile-printing load of ink-jet printing.

Still another object of the present invention is to provide a printing method and apparatus through which it is possible to lower running cost and minimize maintenance.

A further object of the present invention is to provide a printing method and apparatus through which the amount of ink jetted from an ink-jet head is reduced to decrease the amount of ink that attaches itself to the vicinity of the jetting ports, thereby making it possible to reduce the number of cleaning operations needed to remove the attaching ink and, as a result, raise the overall printing speed.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 10 is a diagram showing an example of a palette table in the textile printing apparatus according of the embodiment;

DESCRIPTION OF THE PREFERRED EMBODIMENTS

Preferred embodiments of the present invention will now be described in detail with reference to the accompanying drawings.

In this specification, the term "printing" includes the meaning of "textile printing" and refers broadly to applying an image to a printing medium such as cloth or paper.

Examples of printing media that can be mentioned include cloth, wallpaper, paper and an OHP sheet. The present invention is particularly well suited to a printing medium having a low water absorbency, such as cloth or wallpaper. Further, in the present invention, the term "cloth" refers to all woven, unwoven or other fabrics irrespective of the material, the manner of weaving and the manner of knitting. Further, in this embodiment, the term "wallpaper" encompasses a material affixed to a wall, in which the material is paper, fabric or synthetic resin sheet such as polyvinyl chloride.

Figure 2:
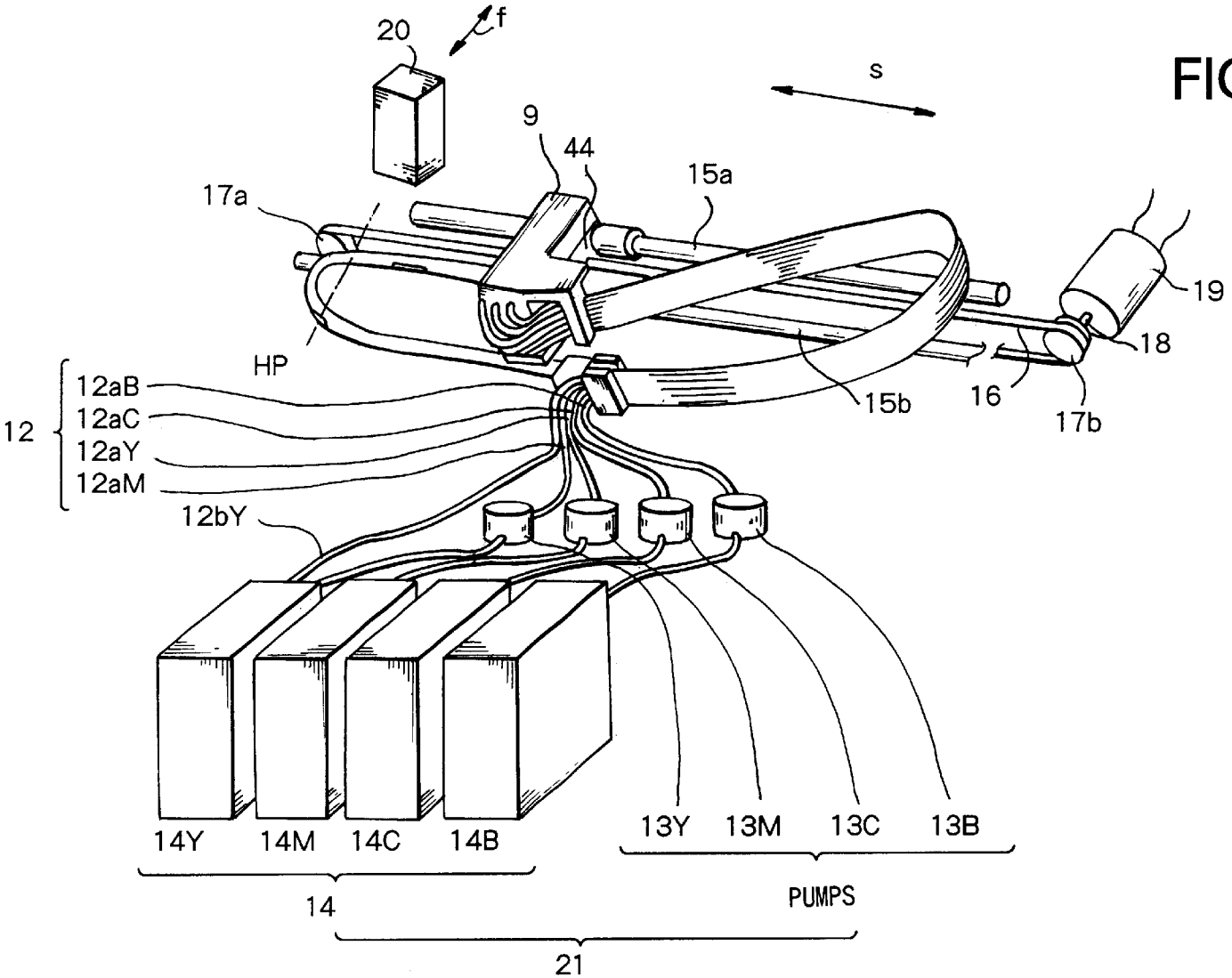
FIG. 2 is a perspective view illustrating the construction of a printing section in the textile printing apparatus according of the embodiment.

FIG. 2 is a perspective view showing the construction of a printing section using an ink-jet head 9 according to this embodiment. The ink-jet head 9 does not possess special-color heads S1~S4, described later.

As shown in FIG. 2, the printing section basically includes two guide rails 15*a,* 15*b,* the ink-jet head (printing head) 9, a carriage 44 for the head, an ink supply device 21, a head recovery device 20 and electrical circuitry and cables, which are not shown. The ink supply device 21, which contains ink and supplies the printing head 9 with the required amount of ink, has ink tanks 14 and ink pumps 13. The ink supply device 21 and printing head 9 are connected by ink supply tubes 12. Ordinarily, the printing head 9 is supplied with ink automatically by capillary action in an amount jetted from the print head. Further, when a head recovery operation, described below, is carried out, the printing head 9 is forcibly supplied with ink using the ink pumps 13.

The printing head 9 and ink supply device 21 are mounted on the head carriage 44 and an ink carriage, respectively. Though not shown, the ink carriage is guided on other guide rails and is moved along these guide rails, in concurrence with scanning of the head carriage 44, at approximately the same speed as that of the head carriage 44. The latter is fixed to a belt 16 stretched between two pulleys 17*a,* 17*b.* The arrangement is such that the head carriage 44 is reciprocated in the direction of arrow S along the guide rails 15*a,* 15*b* with rotation of the pulley 17*b,* which is mounted on a rotary shaft 18 of a carriage motor 19.

In order to maintain the stability of the ink-jetting operation performed by the printing head 9, the head recovery device 20 is provided to confront the printing head 9 at a home position HP. As for the details of operation of the head recovery device 20, the later is advanced in the direction of arrow f when it is non-operative. In order to prevent evaporation of ink within the nozzles of the printing head 9, the head recovery device caps the printing head 9 at the home position HP (this is a capping operation). Alternatively, in order to discharge air bubbles or contaminants from within the nozzles before the printing of an image begins, it is necessary to pressurize the ink flow passage of the printing head 9 using the ink pumps 13, thereby forcibly discharging the ink from the nozzles (this is a pressurized recovery operation). At this time the head recovery device 20 functions to recover the discharged ink.

Figure 3:
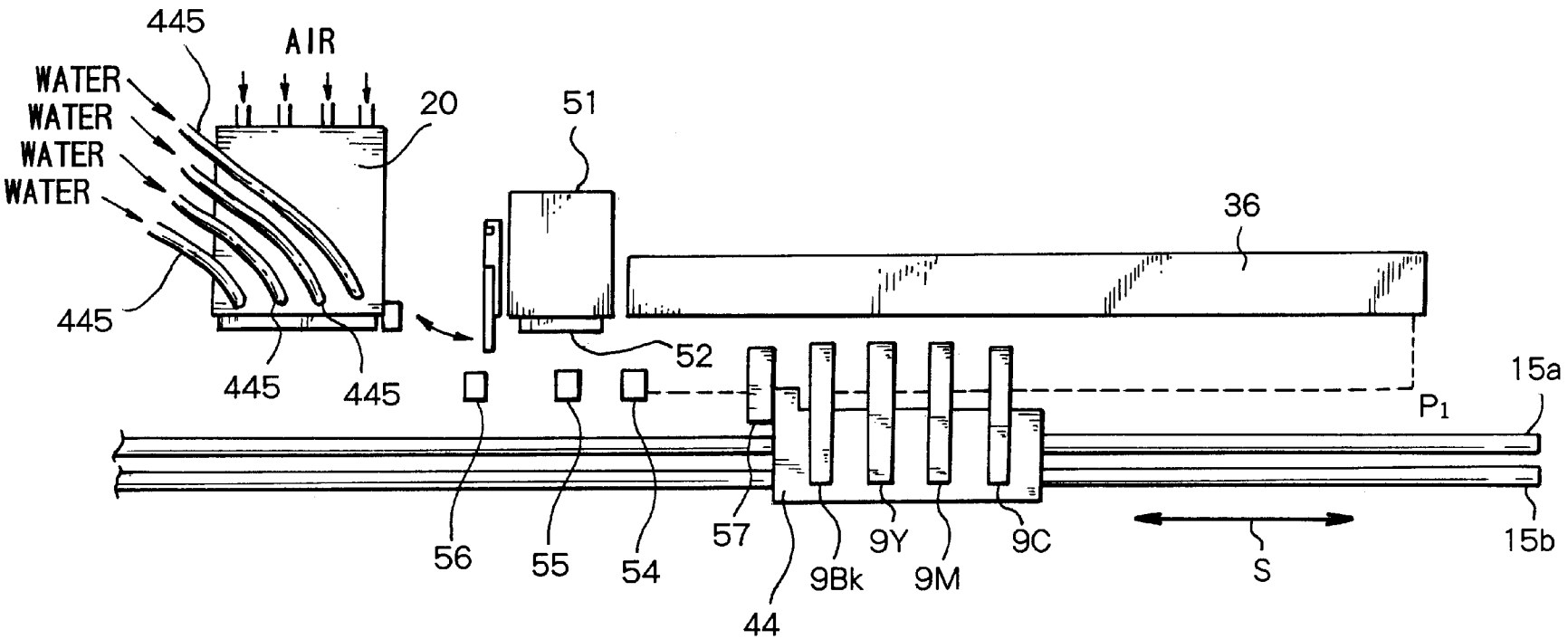
FIG. 3 is a top view showing the construction of the printing section.

FIG. 3 is a plan view for describing the operation of the printing section of this embodiment. Elements identical with those shown in FIG. 2 are designated by like reference numerals and need not be described again.

In FIG. 3, numeral 54 denotes a printing-start sensor used to determine whether the printing head 9 is at the printing starting position. A capping sensor 56 is used to sense whether printing heads 9C, 9M, 9Y, 9Bk are at a prescribed capping position. A preliminary jetting-position sensor 55 is used to sense whether the printing heads 9C, 9M, 9Y, 9Bk are at a reference position of a preliminary jetting operation performed while the heads are moving in the scanning direction. Numeral 57 denotes a line sensor for image sensing.

It should be noted that the heads 9C, 9M, 9Y, 9Bk jet cyan-colored ink, magenta-colored ink, yellow-colored ink and black-colored ink, respectively.

The operation of this ink-jet printing apparatus will now be described in detail.

First, in a standby condition, the printing heads 9C, 9M, 9Y, 9Bk are capped by a capping section of the head recovery device 20. When a print signal enters a control circuit 102, which will be described later with reference to FIG. 1, the carriage 44 is conveyed by driving the carriage motor 19 via a motor driver. When the position of the head carriage 44 is sensed by the sensor for sensing the preliminary jetting position, preliminary jetting of ink for a prescribed period of time is carried out by clogging preventing means 51. Next, when the position of the head carriage 44 is sensed by the print-start sensor 54, respective flow passages 12 of the printing heads 9C, 9M, 9Y, 9Bk are selectively driven while the heads travel in the direction of arrow S from the printing starting position. As a result, ink droplets are discharged from the ink-jet heads of the respective colors so as to print an image, in the form of a dot-matrix pattern, on the printing width of a cloth 36.

Next, the printing heads 9C, 9M, 9Y, 9Bk are fed, by an amount corresponding to a prescribed number of pulses, from the printing starting position by rotation of the carriage motor 19 to perform printing on the cloth 36 by means of the ink droplets, after which the head carriage 44 is shifted to the position of P1. This completes one printing scan. The carriage 44 is then reversed and moved in the sub-scan direction to return to the position sensed by the preliminary jetting-position sensor 55. The cloth 36 is concurrently conveyed in the sub-scan direction by an amount equivalent to the printing width. This is followed by repeating the foregoing operation. A head cleaning mechanism 445 performs cleaning using water. This mechanism does not have any direct bearing upon the invention and need not be described in detail.

Figure 1:
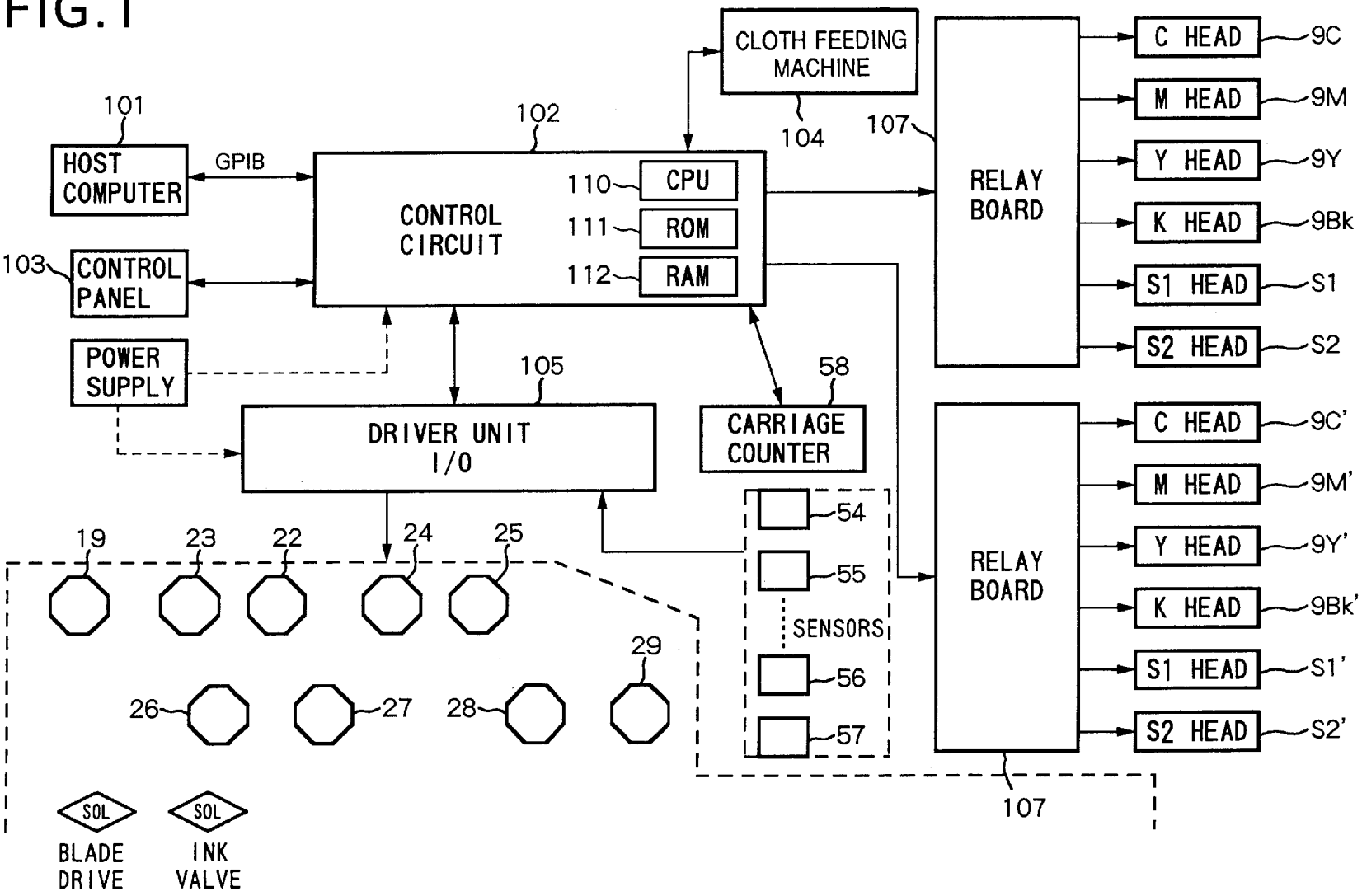
FIG. 1 is a block diagram illustrating the basic construction of a textile printing apparatus according to an embodiment of the present invention.

The overall construction of the textile printing apparatus of this embodiment will now be described with reference to FIG. 1.

Numeral 101 denotes a host computer which transfers printing image data to the control circuit 102 of the apparatus. The source of this image data is not limited to the host computer 101. The data, which can take on various forms, may be transferred by a network or handled off-line via a magnetic tape (MT) or the like. The control circuit 102 supervises overall control of the textile printing apparatus and manages the apparatus. The control circuit 102 has a CPU 110, a ROM 111 storing the control program of the CPU 110, and a RAM 112 used as the work area of the CPU 110. A control panel 103 has various function keys and a display unit for displaying various messages and the like for the operator to see. A cloth feeding machine 104 conveys a cloth to be printed, in accordance with the direction from the control circuit 102. The cloth feeding machine 104 is corresponding to a cloth feeding section B described later according to FIG. 5.

A driver unit 105 drives various actuators, such as a variety of motors and solenoids, in conformity with commands from the control circuit 102, and outputs signals from various sensors to the control circuit 102. The carriage motor 19 is for conveying the head carriage 44. Numeral 23 denotes an ink-feed motor and 22 a conveyance motor for conveying the cloth. Though the ink-jet head 9 in FIGS. 2 and 3 has been described for a case in which there are only four heads for the four colors (C, M, Y, Bk), two special-color heads (S1, S2) of two colors also are mounted on the textile printing apparatus. Further, the head is not limited to one per color. A plurality of heads may be mounted per color to raise the printing speed. In such case the weight and volume of the head carriage 44 increase and, hence, the carriage motor 19 will be larger than that used in an ordinary printer or copier.

In order to perform printing continuously on a cloth having a length of as much as several dozen meters, a large amount of ink is consumed in continuous fashion. In certain cases, an enormous amount of ink is used in, say, one hour. Accordingly, the ink-feed motor 23 is necessary in order to convey the above-mentioned ink carriage, which mounts the ink tanks 14 accommodating a large quantity of ink, in operative association with the head carriage 44. Numerals 24, 25 denote pressurizing motors, and numerals 26, 27 designate capping motor corresponding to cap drivers. As will be described later, two of the capping motors are prepared in order to construct the head in two stages. Numeral 28 denotes an air-recovery motor for the ink-jet head, and 29 a water wipe-off motor for the ink-jet head. The sensors 54~57 sense the position of the ink-jet head and information indicating whether cloth is present or not. When the carriage motor 19 is driven in stepwise fashion, a carriage counter 58 counts the drive pulses to sense the present position of the head carriage 44. A description of fan motors and solenoids is omitted. Head driving signals are sent to each head via a flexible cable and a relay board 107.

Figure 4:
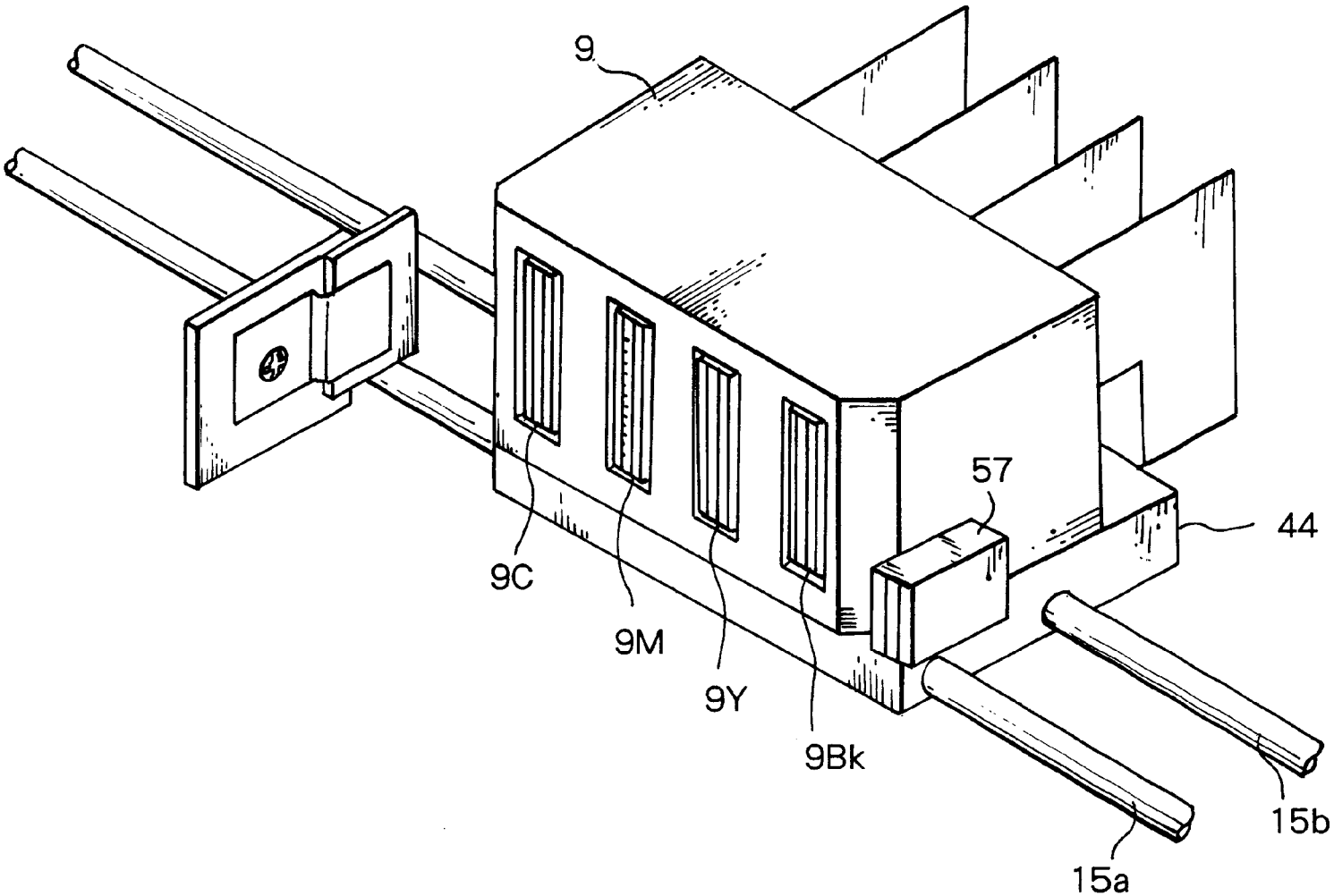
FIG. 4 is a perspective view for describing an ink jetting surface of an ink-jet head according to the embodiment.

FIG. 4 is an external perspective view of the ink-jet head 9, as seen from the printing face thereof, in the printing section of the textile printing apparatus according to this embodiment. Portions similar to those of the other drawings are denoted by like reference numerals and a description thereof is omitted.

Figure 5:
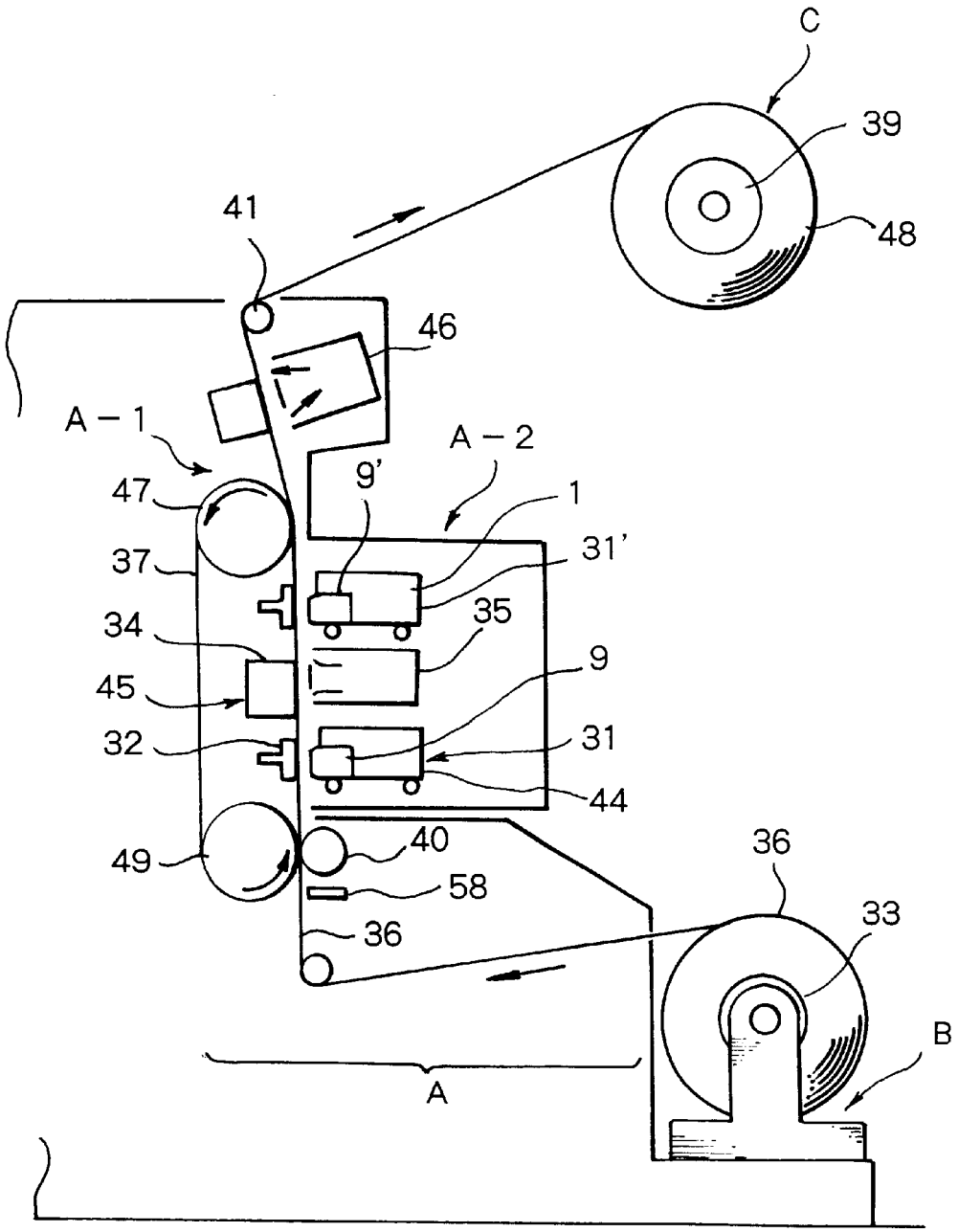
FIG. 5 is a structural sectional view showing the overall construction of the textile printing apparatus according of the embodiment.
Figure 6:
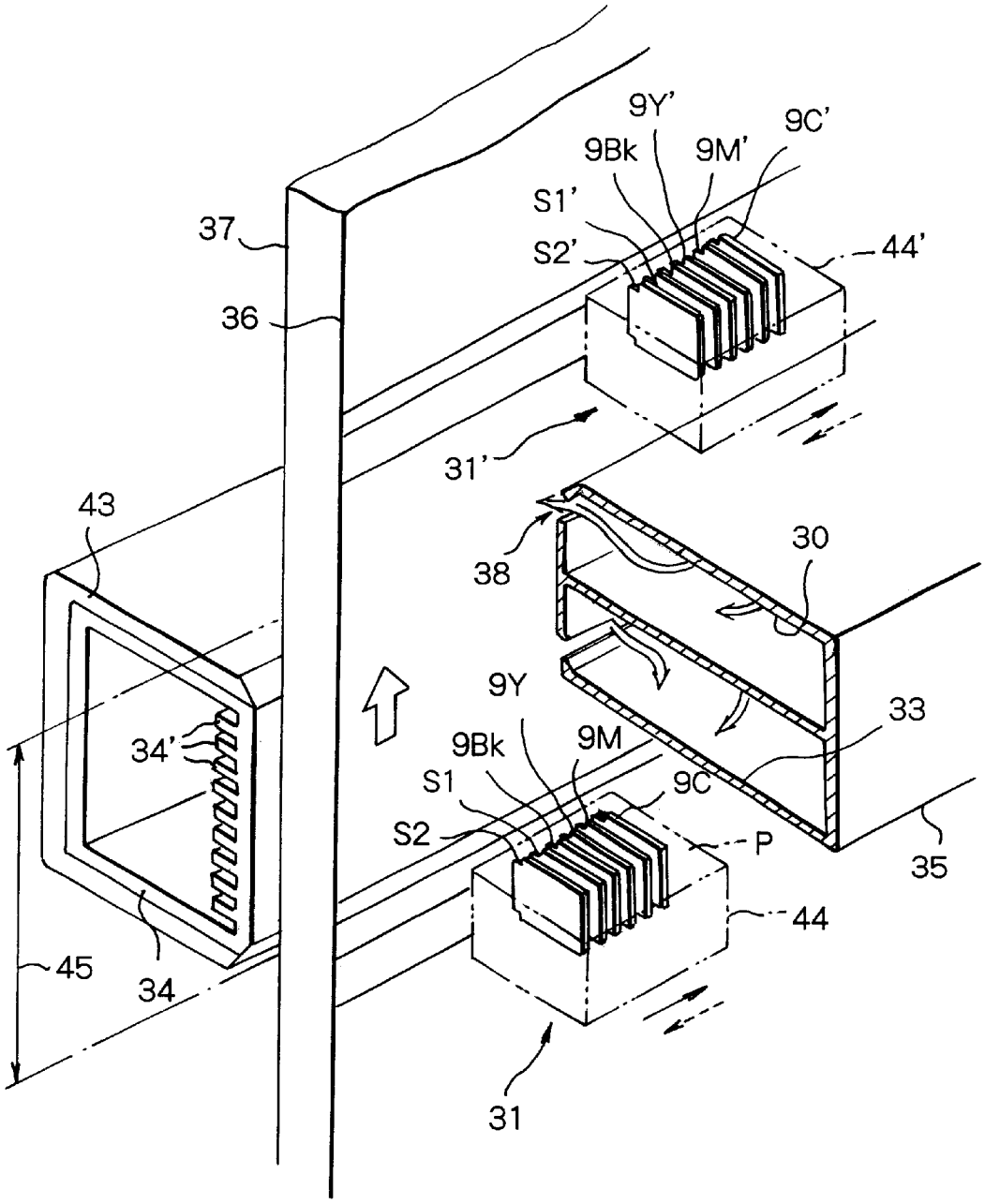
FIG. 6 is a perspective view showing the construction of a printing section and drying section of the textile printing apparatus according of the embodiment.

FIG. 5 shows an example of the construction of an ink-jet printer serving as the textile printing apparatus according to this embodiment. FIG. 6 is an enlarged perspective view of principal portions. The textile printing apparatus (printer) of this embodiment basically comprises a cloth feeding section B for feeding rolled cloth that has been subjected to screen printing, described later, a main section A for accurately feeding delivered cloth line by line and printing on the cloth by ink-jet heads 9, 9', and a take-up section C for drying and taking up the printed cloth. The main section A comprises a cloth precision-feed area A-1 including a platen, and a print unit A-2.

The rolled cloth 36 that has been subjected to screen printing is fed out from the cloth feeding section B and delivered to the main section A. The latter includes a thin endless belt 37, driven stepwise in precise fashion, stretched between a drive roller 47 and a winding roller 49. The drive roller 47 is driven stepwise directly by a high-resolution stepping motor (not shown) so that the belt is fed incrementally by an amount equivalent to each step of the motor. The delivered cloth 36 is pressed against the surface of the belt 37, which is backed up by the winding roller 49, by a pressing roller 40, as a result of which the cloth is affixed to the surface of the belt.

The cloth 36 fed stepwise by the belt 37 is brought to a first printing section 31. Here the cloth 36 is oriented by the platen 32 on the back side of the belt 37 and is printed upon by the ink-jet head 9 from its front side. Whenever one line of printing ends, the cloth 36 is fed stepwise a prescribed amount. Heating is then applied by a heating plate 34 from the back side of the belt, and the cloth is dried from its front side by hot air supplied/discharged by a heating duct 35. Next, at a second printing section 31', superposed printing is performed through a method similar to that applied at the first printing section.

The cloth 36 on which printing has been completed is peeled off the belt 37, dried again by a post-drier 46, which comprises a heating plate and a heating duct, and then introduced to a guide roll 41 so that the cloth is taken up on a take-up roller 48. The cloth 36 thus taken up is removed from the apparatus and then subjected to post-treatment after being colored, washed and dried by patch processing. A manufactured product is thus obtained.

As shown in FIG. 6, the cloth 36 serving as the printing medium is fed stepwise upwardly in FIG. 6 while being supported on the belt 37. Located at the first printing section 31 at the lower part of FIG. 6 is the first carriage 44 mounting ink-jet heads for special colors S1, S2 besides the ink-jet heads for the colors Y, M, C and Bk. The ink-jet heads (printing heads) in this embodiment are those that employ heating elements for generating thermal energy that produces film boiling in the ink. This energy is utilized in order to jet the ink. Use is made of an array of 128 jetting ports at a density of 400 dpi (dots per inch).

A drying section 45 comprising the heating plate 34 for applying heating from the back side of the belt 37 and the heating duct 35 for performing drying from the front side is provided downstream of the first printing section 31. The heat-transfer surface of the heating plate 34 is pressed against the tightly tensioned endless belt 37. The conveyor belt 37 is heated strongly from the back side thereof by high-temperature, high-pressure steam passed through the hollow interior of the heating plate. The surface on the inner side of the heating plate 34 is provided with fins 34' for concentrating the heat. As a result, the heat is concentrated efficiently at the back of the belt 37. The side of the heating plate 34 that does not contact the belt is covered by an insulator 43. This prevents heat loss due to radiation.

On the front side, warm, dry air is blown against the cloth 36 from the supply duct 30 on the downstream side, whereby air having a lower humidity is made to contact the cloth 36 while the cloth is being dried. This raises drying efficiency. Air containing sufficient moisture flowing in a direction opposite that in which the cloth 36 is conveyed is drawn from a suction duct 33, located on the upstream side, in an amount much greater than that blown against the cloth, thereby assuring that condensation will not be produced on peripheral equipment by leakage of water vapor. The source of the warm-air supply is located in the inner reaches of FIG. 6, and suction is carried out from the front side. The pressure difference between a blow hole 38 and a suction hole opposing the cloth 36 is rendered uniform across the entire length of the duct 30. This section for blowing and withdrawing air is offset toward the downstream side from the center of the heating plate 34 on the back side so that air will strike the sufficiently heated portion of the cloth. Thus, the first printing section dries strongly a large amount of water in the ink, which contains a diluting solution, accepted by the cloth 36.

The second printing section 31' is located farther downstream (toward the upper part of the drawing). The second printing section 31' is formed by a second carriage 44', the construction of which is the same as that of the first carriage 44.

Figure 7:
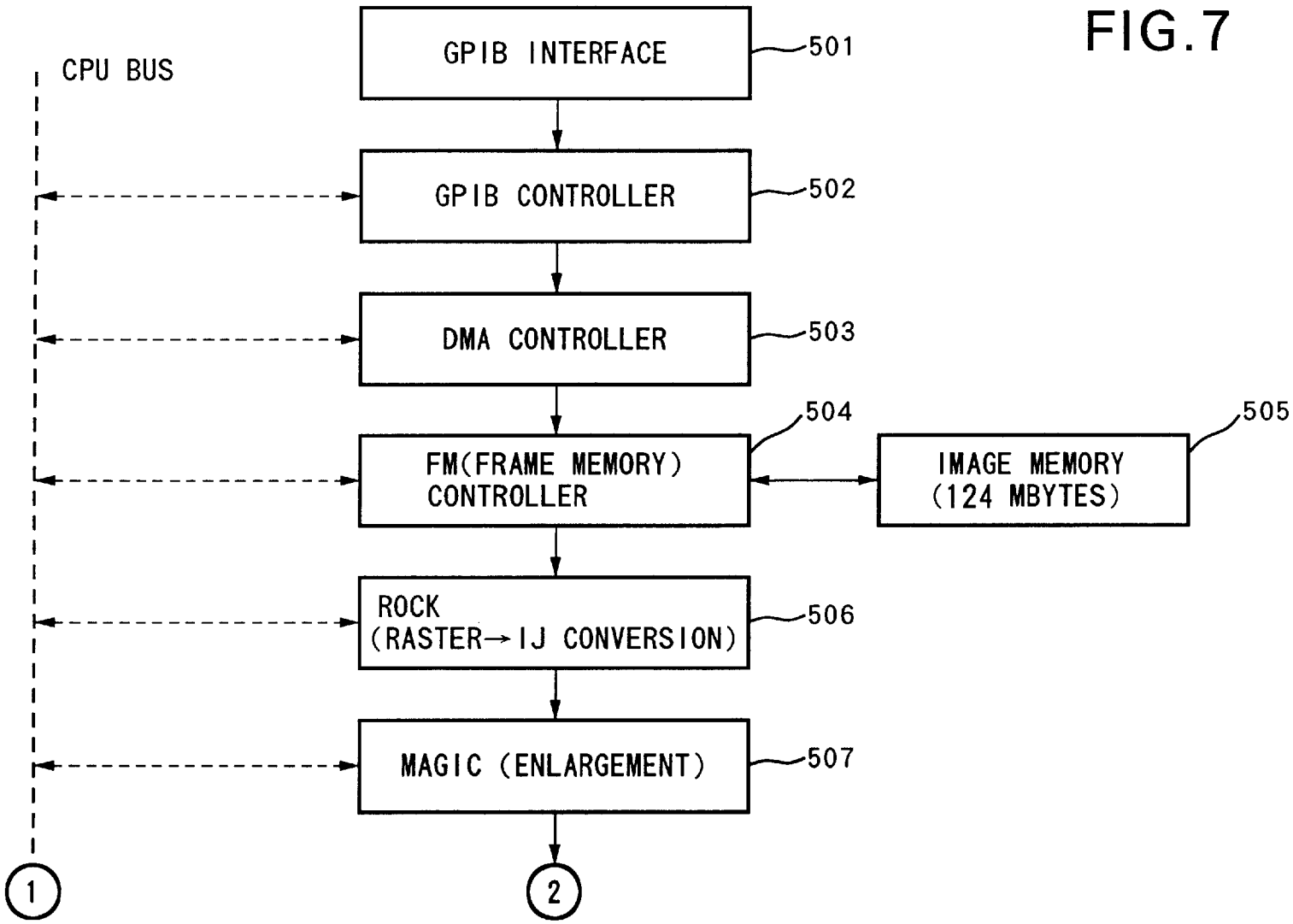
FIG. 7 is a diagram showing the flow of image signals in the textile printing apparatus according of the embodiment.
Figure 8:
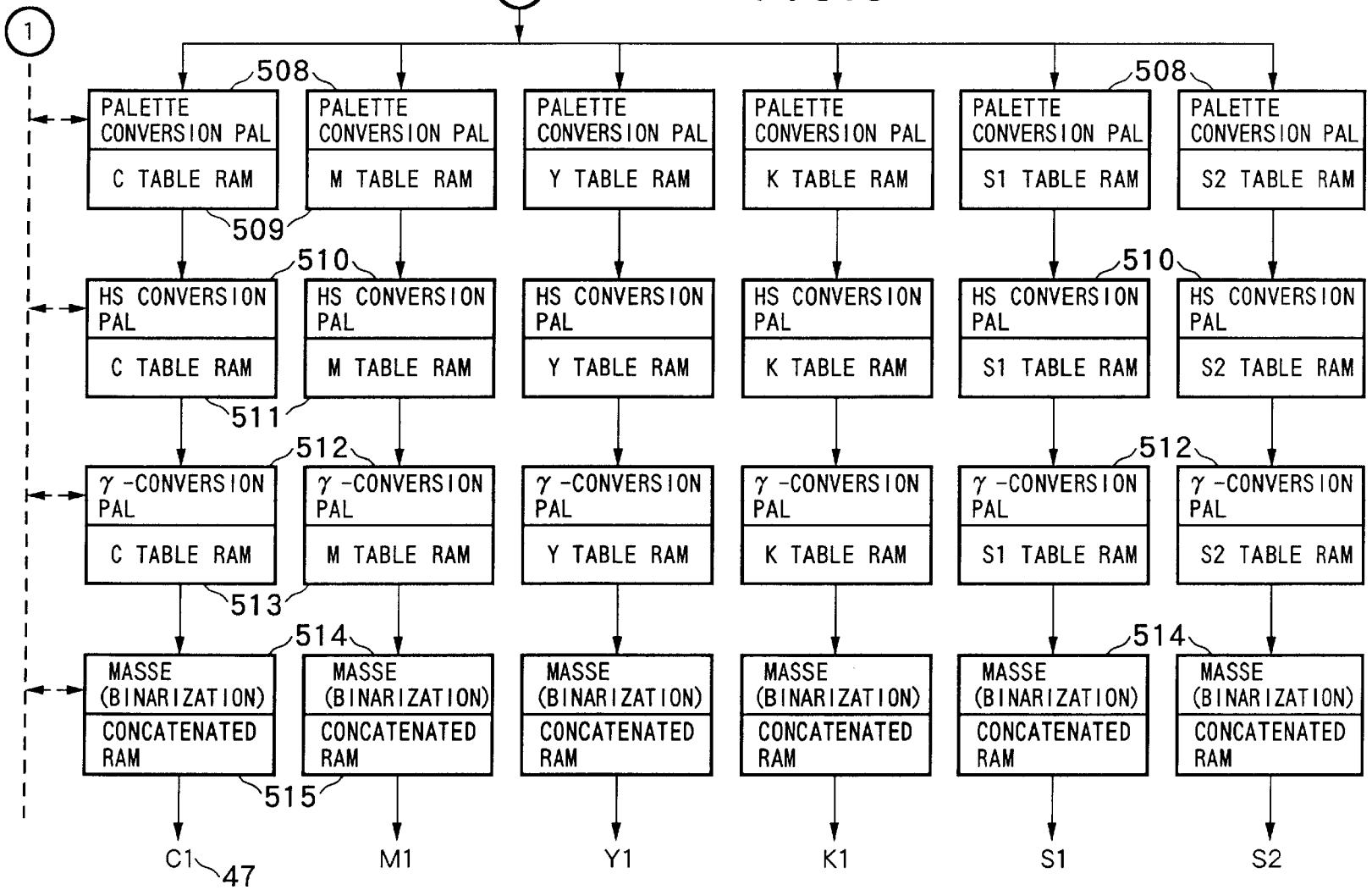
FIG. 8 is a diagram showing the flow of image signals in the textile printing apparatus according of the embodiment.
Figure 9:
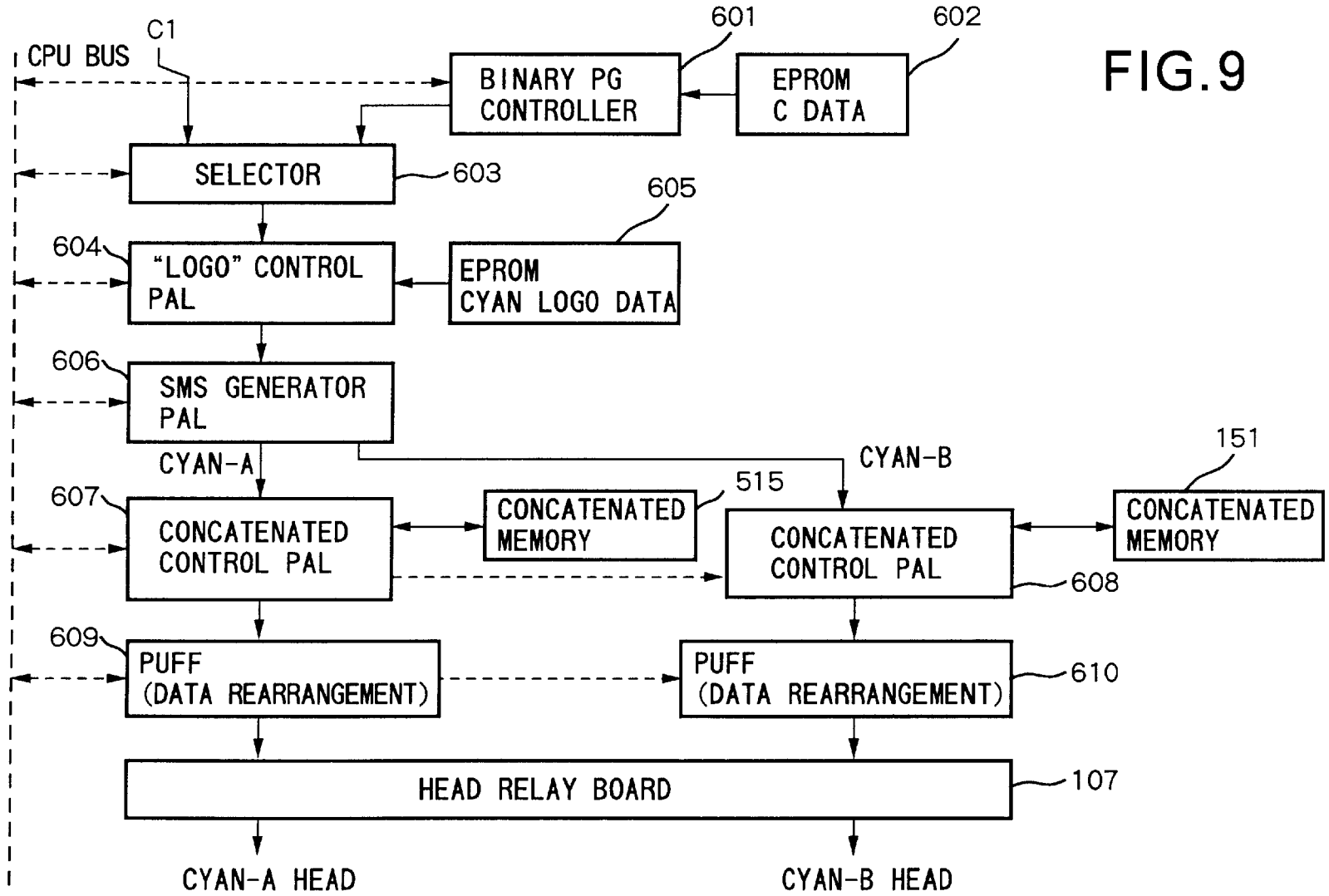
FIG. 9 is a diagram showing the flow of image signals in the textile printing apparatus according of the embodiment.

FIGS. 7 through 9 are block diagrams illustrating the flow of image data in an image processing circuit provided in the textile printing apparatus of this embodiment.

Image data and palette-table data sent from the host computer 101 is received by a GPIB interface 501 and GPIB controller 502 of the control circuit 102 and stored in an image memory 505 of the RAM 112 via a DMA controller 503 and FM (frame-memory) controller 504. The image memory 505 has a memory space of 124 megabytes and is capable of storing image data of size A1 in the form of eight-bit palette data. When a prescribed quantity of image data is thus stored in the image memory 505, a printing start signal is received from the CPU 110, image data starts to be read out of the image memory 505 and printing processing begins.

Since image data sent from the host computer 101 is a raster image, it is necessary to convert the raster data in conformity with the array of nozzles of the ink-jet heads in the first and second printing sections 31, 31'. This is carried out by a converter (ROCK) 506. Furthermore, the image data thus converted is enlarged by an enlarging unit (MAGIC) 507. The signal outputted by the enlarging unit (MAGIC) 507 is the very data received from the host computer 101. In this embodiment, the signal is an eight-bit palette signal.

In FIG. 8, a palette-conversion device (programmable array logic, abbreviated to PAL) 508 effects a conversion to color data by referring to a conversion table (SPAM) corresponding to each device. In this embodiment, two special colors S1, S2 are provided in addition to the four colors of cyan (C), magenta (M), yellow (Y) and black (K), for a total of six colors.

FIG. 10 illustrates examples of conversions of image data performed by these palette tables. In case of an eight-bit palette, there are 256 inputs of 0~ 255. These examples of conversions are as follows, with reference being made to FIG. 10:

When "0" is entered: a light gray color is obtained (cyan, magenta and yellow are all "10")

When "1" is entered: solid "255" printing is performed in special color 1 (S1)

When "2" is entered: solid "255" printing is performed in special color 2 (S2)

When "3" is entered: a bluish color is obtained by a color mixture of cyan and magenta (both "150")

When "4" is entered: solid "255" printing is performed in black

When "5" is entered: a reddish color is obtained by a color mixture of magenta and yellow (both "200")

When "6" is entered: a color more reddish than in the case of "5" is obtained by a color mixture magenta and cyan - - -

When "254" is entered: solid "255" printing is performed in yellow

When "255" is entered: nothing is printed

An example of a concrete circuit arrangement of such a palette conversion table is a so-called look-up table, in which the input (palette data) is applied to a RAM address and data that has been stored at this address is adopted as a conversion value. Of course, if the conversion data of this conversion table is fixed, the table may comprise a ROM instead of a RAM. Thus, the device (PAL) 508 for palette conversion manages the RAM 112 and functions as an interface with respect to the CPU 110.

The next stage, namely an HS conversion PAL 510, compensates for a variance in printing density corresponding to each jetting nozzle of the ink-jet heads. This also is a table conversion. For example, a data conversion to greater density is made for a nozzle exhibiting low printing density, and a data conversion to lower density is made for a nozzle exhibiting high printing density. No change is made for a nozzle exhibiting intermediate density. An SRAM 511 for table conversion is similar to the SRAM 509.

A γ-converter 512, which is the next stage, raises and lowers overall density for each color. As in the case of the above-described palette conversion and HS conversion, the γ-converter 512 has a table 513 corresponding to each color. In a case where no conversion is made by the γ-converter 512, a conversion based upon a linear-characteristic table is carried out. More specifically, "0" is outputted in response to a "0" input;

"100" is outputted in response to a "100" input;

"210" is outputted in response to a "210" input; and

"255" is outputted in response to a "255" input.

The next stage, namely MASSE (a binarizing circuit) 514 has a pseudo-tone function. The input is eight-bit tone data and the output is binarized one-bit pseudo-tone data. Tone representation is based upon the number of ink-jet dots printed per unit area. Though the details are not described, densities of an image desired to be printed are saved successively in concatenated memories (SRAMS) 515. Thus, items of binarized data C1, M1, Y1, K1, S1, S2 corresponding to the respective colors are generated. Since the binarized signals of the respective colors subsequently pass through similar circuitry, the following description will deal solely with the cyan data C1.

As shown in FIG. 9, the binarized C1 signal eventually enters an SMS simulator 606. However, since a pattern generator (PG) 601 for textile printing in the printer and data in an EPROM 602 may also be used before this occurs, a selector 603 is provided to change over between the signals. Data for pattern generation (PG) is stored in the EPROM 602, and the output of the EPROM is capable of being read under the control of the binary PG controller 601.

In case of textile fabrics, a logo such as the brand name of the maker often appears on the edge of the fabric. Logo data for this purpose is stored in the EPROM 605. Furthermore, a logo controller 604 manages the position at which the logo is printed, the length of the logo, etc.

The SMS (sequential multiscan) generator 606 generates data for performing printing, in which dots are superimposed by a plurality of ink-jet heads. The purpose of this is (A) to correct irregular density of the ink-jet heads, and (B) to raise printing density. The effect of this resembles that of the HS converter PAL 510, described above. The SMS generator 606 outputs the input data in a prescribed sequence to a concatenated-memory controller 607 and a concatenated-memory controller 608 by switching between the two. Concatenated memories 151, 155 are data accumulating memories for correcting data output timing based on the physical positions of the heads. The input image data is accumulated temporarily and read out at a timing conforming to the physical positions of the heads. The concatenated-memory controllers 607, 608 are controllers for managing the concatenated memories 515, 151.

Numerals 609, 610 denote data rearranging units (PUFFs) for rearranging data in conformity with the ink-jet heads. The cyan data resulting from this conversion is sent to two heads 9C, 9C' via the relay board 107. Since operation is performed in the same manner with regard to the other colors, this need not be described.

The construction of a flat-type automatic screen textile printing machine will now be described, with reference to FIG. 11, as a textile printing apparatus other than that which relies upon the ink-jet method set forth above.

The cloth 36 is fed into an endless belt 702 by a cloth feeding device 701. Since a soluble rubber paste has been applied to the surface of the endless belt 702 by a belt pasting device 703, the cloth 36 becomes firmly affixed to the belt 702. As a result, the cloth 36 is delivered by rotation of a drive roller 704 in accordance with movement of the belt 702, and an operation in which the cloth is advanced and temporarily stopped is repeated in operative association with movement of the belt 702. When the cloth is temporarily stopped, a screen frame 705 is lowered onto the cloth 36. At the same time a paste spatula is operated automatically by a separate mechanism to perform printing on the cloth 36. Pre-printing processing is executed by repeating the same operation a number of times equivalent to the number of colors printed. When the pre-printing operation ends, the cloth 36 is peeled off the belt 702, passed through a drier 706 and introduced to textile printing process, which relies upon the ink-jet method described earlier. It should be noted that the paste that has been applied is washed off by a washing unit 707 separate from that of the cloth 36, at which time the water content of the belt 702 also is removed by a heater 708. The belt is then advanced to the front of the machine. Soluble rubber paste is applied by the belt pasting unit 703 in the manner described above and an operation similar to that set forth above is repeated.

Screen textile printing and textile printing by the ink-jet method have been described above. Described next will be the construction and example of operation of a textile printing system that combines these two methods.

Figure 11:
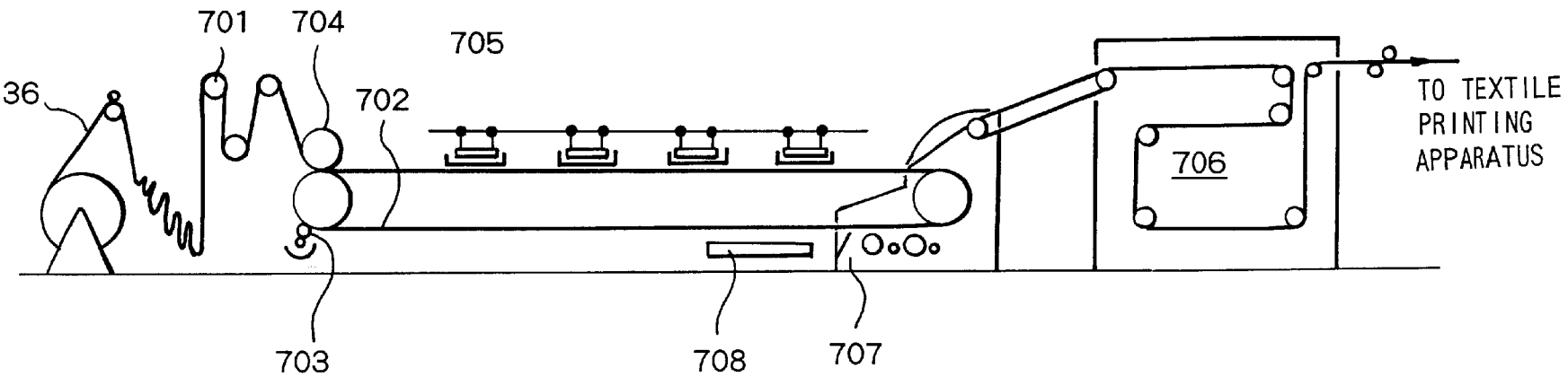
FIG. 11 is a diagram showing a screen textile printing apparatus according to an embodiment of the present invention.

In the screen textile printing process shown in FIG. 11, cross marks, which are images representing position, are formed on a screen printing plate together with a printing pattern. The cross marks are printed along the edge of the cloth 36 at regular intervals in the screen printing process. As a result, position information corresponding to the pattern position on the cloth 36 is capable of being added to the cloth 36 by being printed.

Ordinarily, a logo such as a company name is printed along the edge of the cloth 36. As long as the logo is not a mark that may be mistakenly recognized as a cross mark, any type of logo mark may be used without causing problems. By loading the cloth 36, which has thus been subjected to screen printing, in the above-described screen textile printing apparatus, position images can also be printed with facility at the same time that a pattern is printed.

The cloth 36 that has passed through this screen textile printing process is loaded in the textile printing apparatus shown in FIG. 5, whereby the cloth is conveyed by the pressing roller 40 and belt 37.

As described above, the head carriage prints on the cloth 36 while it travels on the guide shafts 15*a*, 15*b*. At this time the image (cross mark) printed on the edge (the left edge, for example) of the cloth 36 is read in by the image-sensing line sensor 57 in synchronism with control for driving the carriage motor 19. The distances between the line sensor 57 and the printing heads 9M~S2 are predetermined, and so is the length from the cross mark to the position at which printing of the image starts. Therefore, when dot strings (forming the cross mark) composed of a prescribed number of consecutive dots in the longitudinal and transverse directions are detected, this means that the printing starting position of each ink-jet head has been found.

This processing will now be described with reference to the flowchart of FIG. 12 and the diagram of FIG. 13. The following description relates to the first printing section 31 relying upon the carriage 44. It goes without saying that processing is realized in the same manner also with regard to the printing section 31' having the carriage 44'.

Figure 12:
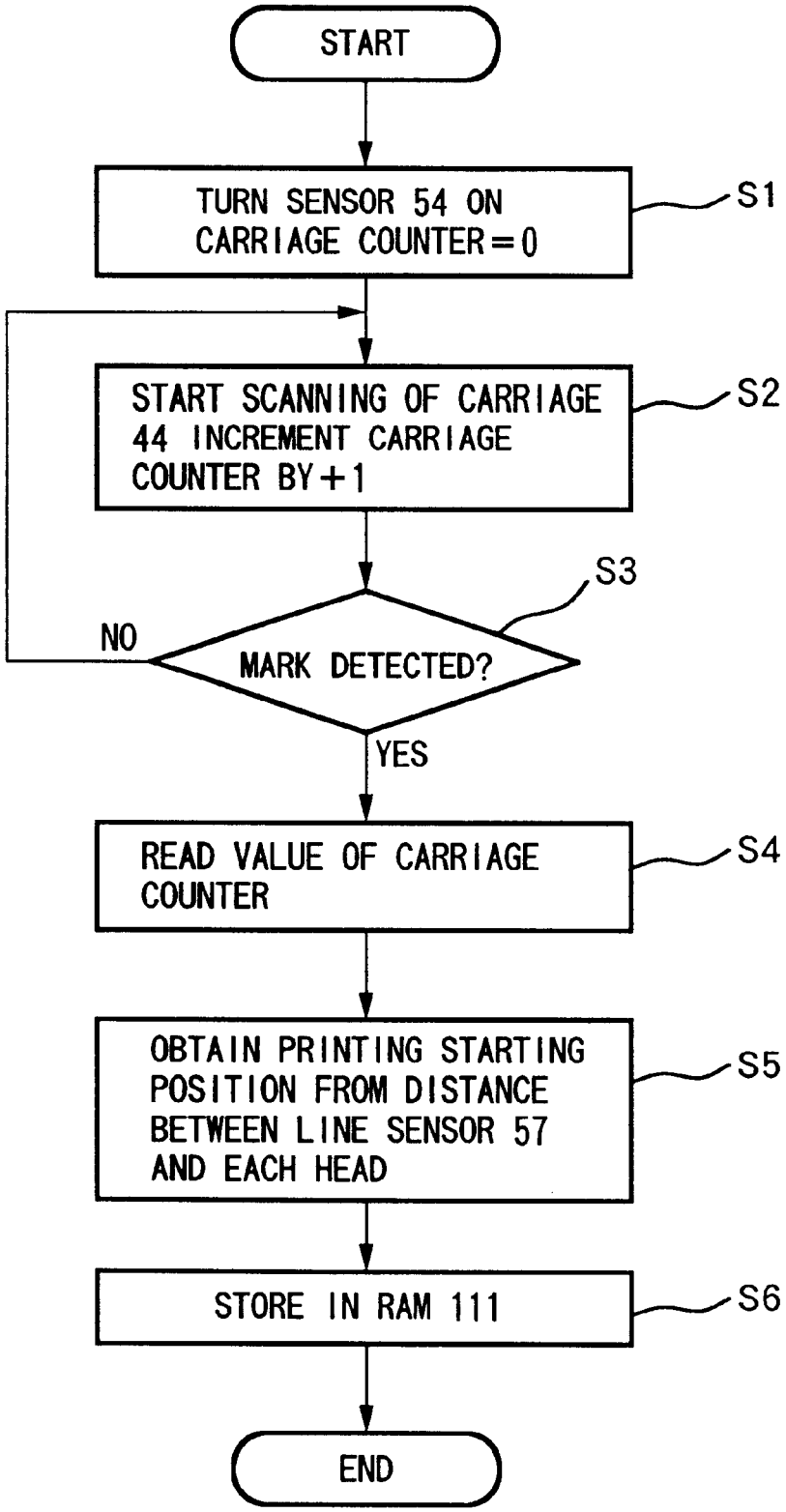
FIG. 12 is a flowchart illustrating processing for reading marks on cloth in an ink-jet textile printing apparatus according to this embodiment.

At step S1 in FIG. 12, the head carriage 44 is moved to a position sensed by the printing-start sensor 54, at which time the carriage counter 58 is cleared to "0". Next, at step S2, the head carriage 44 starts moving to the left and the carriage counter 58 is incremented each time the carriage motor 19 is rotated by one step. This operation is performed until a cross mark 231 (see FIG. 13) is sensed. When the cross mark 231 is sensed by the line sensor 57, the value of the count prevailing in the carriage counter 58 at this time is read.

Figure 13:
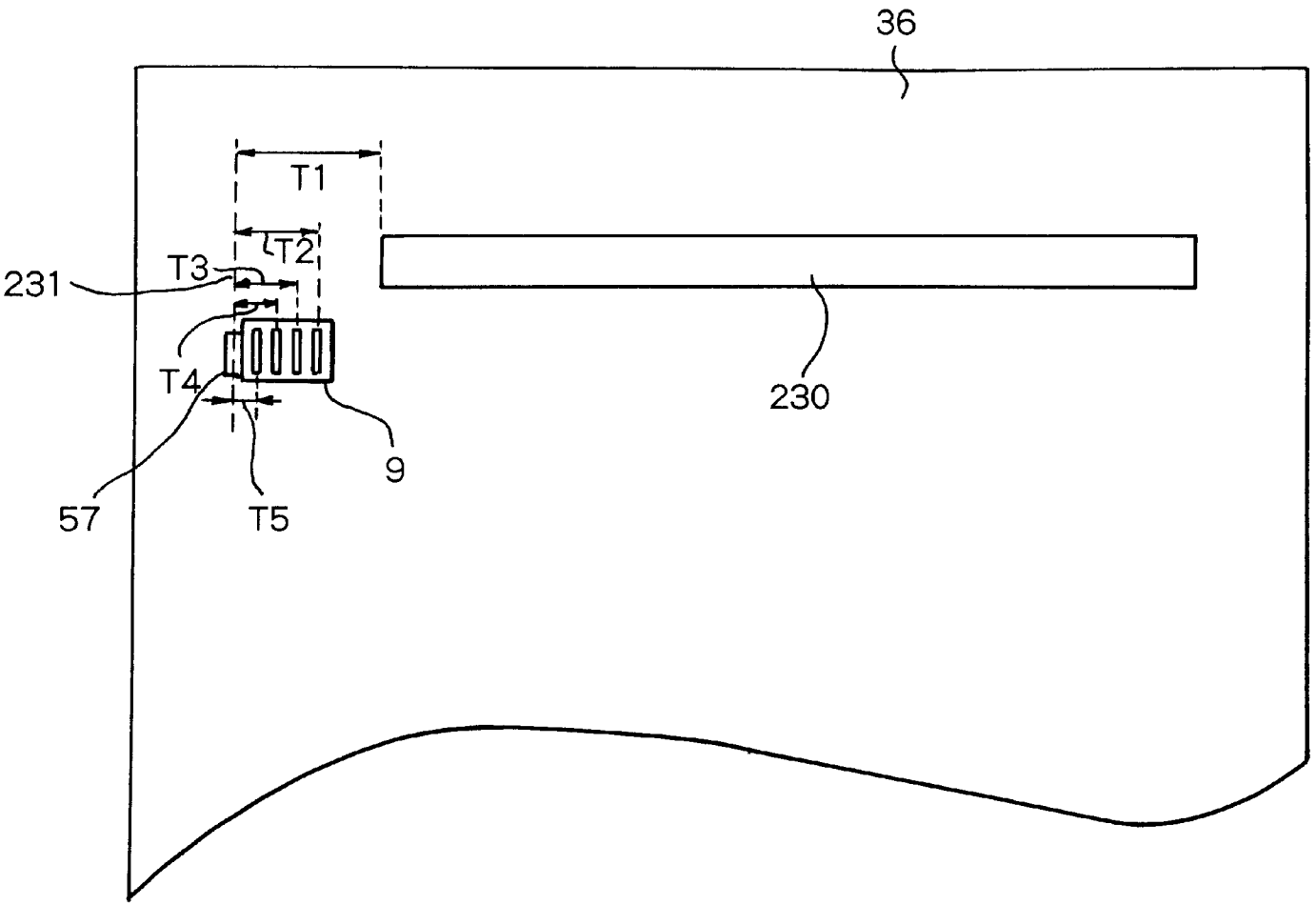
FIG. 13 is a diagram for describing the position of an ink-jet head when a cross mark is read in ink-jet textile printing apparatus according to this embodiment.

The condition is shown in FIG. 13. Here the special-color heads S1, S2 are omitted. As shown in FIG. 13, the line sensor 57 is situated above the cross mark 231. The spacing between the cross mark 231 and the leading end of an image area 230 is represented by T1. Further, the spacings between the line sensor 57 and the cyan head 9C, magenta head 9M, yellow head 9Y and black head 9Bk are represented by T2, T3, T4 and T5, respectively. These spacings (T1~T5) are predetermined.

This is followed by step S5, at which a printing starting position for printing by the ink-jet head of each color is obtained. The printing starting position as found are stored in the RAM 112 in correspondence with the step number of the carriage motor 19 (step S6).

Figure 14:
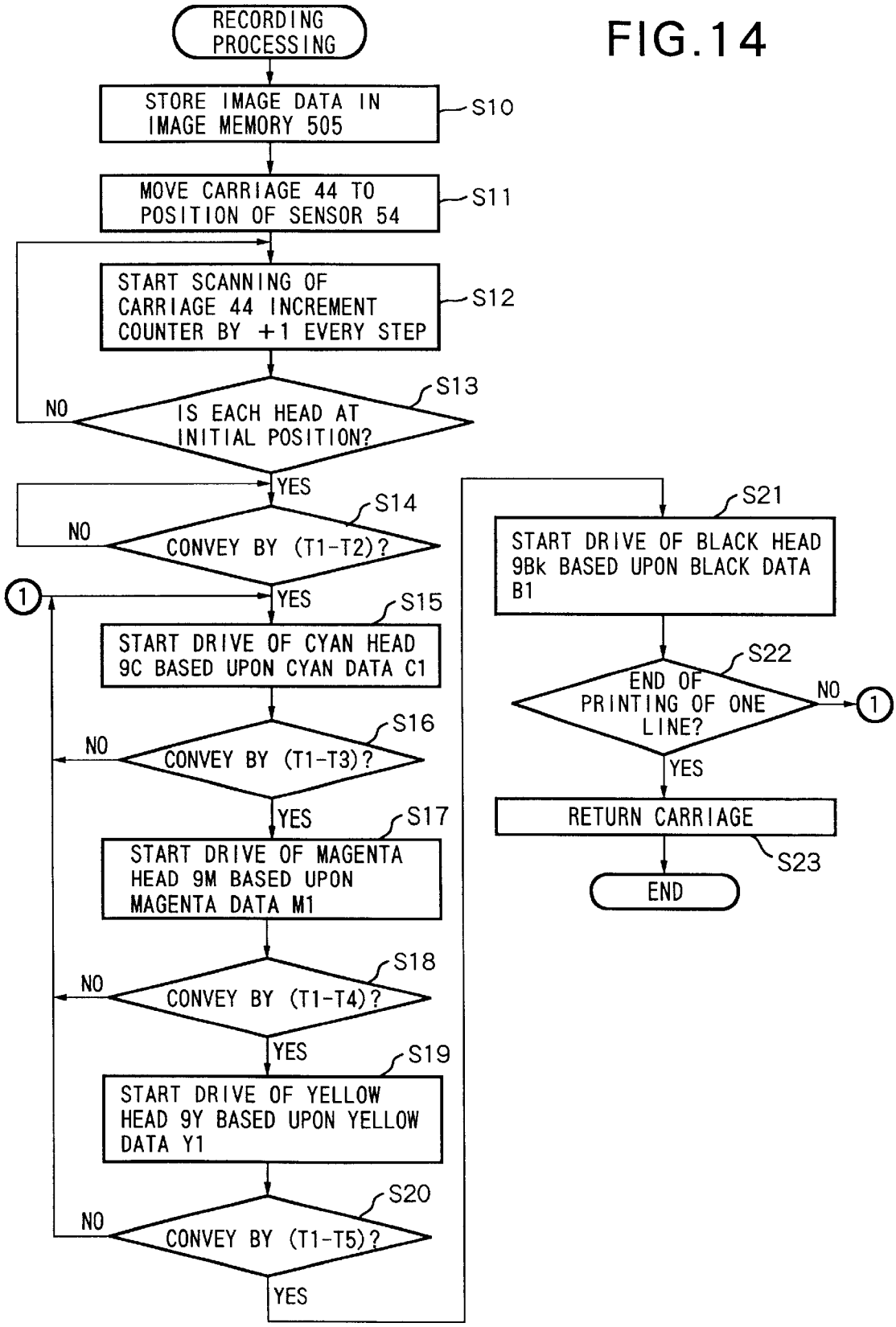
FIG. 14 is a flowchart showing printing processing in the ink-jet textile printing apparatus according to this embodiment.

Next, a case in which one line of printing is actually performed will be described with reference to the flowchart of FIG. 14. Here processing of FIG. 12 for finding the printing starting position and printing processing in FIG. 14 are illustrated by different flowcharts. However, the processing illustrated by the flowchart of FIG. 12 may be executed before the printing processing each time the carriage is scanned.

First, at step S10 in FIG. 14, image data to be printed is stored in the image memory 505, the head carriage 44 is moved rightward from the home position and continues to be moved up to the position sensed by the printing-start position sensor 54 (step S11). The carriage counter 58 is cleared to zero at this time. Next, the program proceeds to step S12, at which scanning of the carriage 44 is started. The carriage counter 58 is incremented each time the carriage motor 19 is rotated by one step. Whether each ink-jet head has reached the position shown in FIG. 13 is determined by comparing the number of steps stored in the RAM 112 and the value in the carriage counter 58. When the two agree, the program proceeds to step S14, where the image memory 505 starts being read and it is judged whether the carriage 44 has been conveyed by (T1–T2). If the carriage 44 has been conveyed by (T1–T2), this means that the cyan head 9C has reached the leading end of the image area 230. The program then proceeds to step S15, at which driving of the cyan head 9C is started based upon the cyan data C1 and printing of the cyan data begins.

Next, the program proceeds to step S16, at which the head carriage 44 is conveyed rightward to be moved by (T1–T3) or more, whereupon printing of the magenta data M1 starts at step S17. Thenceforth, and in similar fashion, printing of the yellow data begins (step S19) when the head carriage 44 has been moved by (T1–T4) or more, and printing of the black data K1 begins (step S21) when the head carriage 44 has been moved by (T1–T5) or more. It is then judged at step S22 whether one line of printing has ended or not. If one line of printing has not ended, the program returns to step S15 so that the above-described processing is executed again. If it is found at step S22 that one line of printing has ended, the program proceeds to step S23, at which the carriage 44 is returned to the home position and the printing processing for one line is terminated. By thus repeatedly executing one line of printing processing, printing can be carried out over the entirety of the cloth 36.

In order to achieve accurate overlapping of patterns in the above-described printing processing, the amount of rotation of the conveyance motor 22 that conveys the cloth 36 is controlled and the image data is displaced in the cloth-feed direction when this data is converted in conformity with the nozzle array of the ink-jet heads. By thenceforth performing an operation similar to that of the ink-jet printing apparatus, textile printing is carried out and then drying and coloring processes to complete textile printing processing.

An ideal example of an ink-jet textile printing method will now be described.

Figure 15:
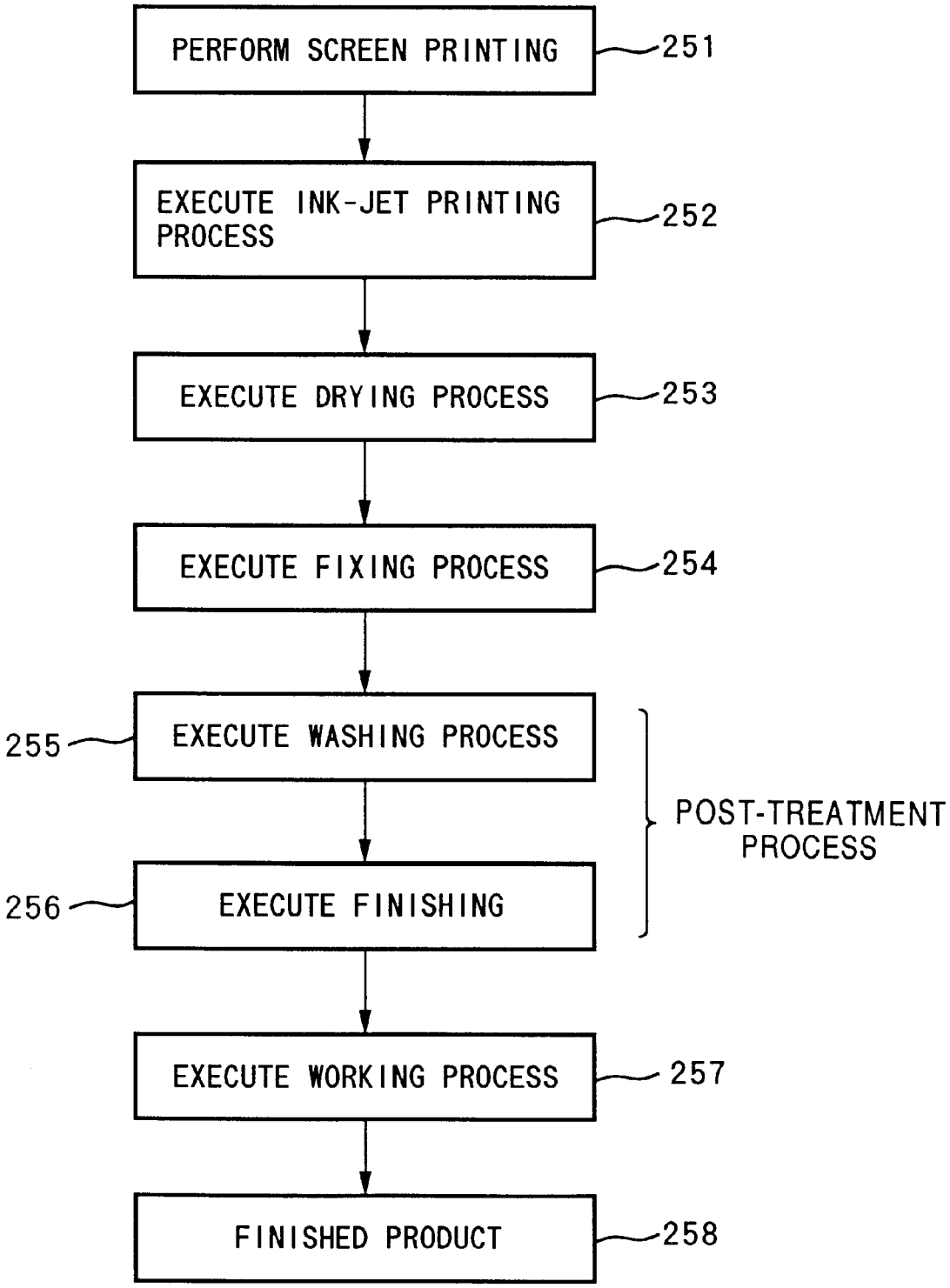
FIG. 15 is a diagram for describing an ink-jet textile printing method according to this embodiment.

FIG. 15 is a flowchart for describing the textile printing method. Cloth is printed on at a screen printing step 251, after which an image is printed on the cloth at an ink-jet printing step 252. This is followed by drying (inclusive of natural drying) (step 253). Next, a fixing step 254 is executed. Here dye on the fibers of the cloth is dispersed and the dye is caused to fix on the fibers by reactive fixing. As a result of step 254, it is possible to obtain satisfactory color generation and fastness of the dye by fixing.

The dispersion and reactive fixing process 254 may be one well known in the art. For example, a steaming method can be mentioned. In this case, the cloth may be subjected to an alkaline treatment before the printing step 252.

Thereafter, in a post-treatment process, unreacted dye is removed and substances used in pre-treatment are removed (washing step 255). Finally, printing is completed through an adjusting and finishing step 256, at which defects are corrected and the cloth is ironed. It should be noted that the finishing step 256 may include removing the marks by applying light or heat to the marks, which have been printed using ink having low light resistance or low heat resistance.

In the embodiment set forth above, screen printing and ink-jet printing are applied to the same side of the cloth 36. However, it is possible to apply screen printing to one side of the cloth and ink-jet printing to the other side. In such case the cloth 36 that has been subjected to screen printing would be conveyed with its unprinted side faced toward the ink-jet heads. The image-sensing line sensor 57 would be placed at a position on the right edge of the cloth to read the position image (the cross mark). Thenceforth, and in similar fashion, printing processing by the ink-jet method would be applied in correspondence with pattern positions on both sides of the cloth.

Further, in the foregoing embodiment, the position image (cross mark) is applied to the position of the logo. However, this does not impose a limitation upon the invention, for the mark may be placed at an appropriate location which can be positioned at will. There are various methods available for applying the position image. Examples are as follows:

(1) The position mark is printed using a printing plate of an inconspicuous color, such as the color yellow, and the sensitivity of the image sensor 57 is made to conform to this color.

(2) Printing is performed using an ink having a very low light resistance, printing is performed by the ink-jet method and then the ink is erased by irradiation with light, such as ultraviolet light.

(3) Printing is performed using ink having a low heat resistance, printing is performed by the ink-jet method and then the ink is erased by heating, as in a color-generation treatment.

The printed matter that has been subjected to the post-treatment described above is subsequently cut to a desired size and the cut pieces are subjected to a working step 257, which is for obtaining a processed article by sewing, bonding or fusing the cut pieces together. Thus, a final manufactured product 258 is obtained. Examples are apparel such as a one-piece dress, skirt, necktie or bathing suit, as well as a mattress cover, sofa cover, handkerchief, curtain, etc. Methods of working cloth such as by sewing to obtain apparel or other useful products are described in many well-known publications. It is also well known matter to make clothing or daily necessities by processing (e.g., sewing) clothes.

Furthermore, in ink-jet printing according to this embodiment, a printing apparatus is described that is one of the ink-jet recording types, in which means (e.g., an electrothermal transducer or laser beam, etc.) is provided for generating thermal energy as energy utilized in order to jet ink, wherein a change in the state of the ink is caused by the thermal energy. With this arrangement, high-density, high-definition recording can be achieved.

With regard to a typical configuration and operating principle, it is preferred that the foregoing be achieved using the basic techniques disclosed in the specifications of U.S. Pat. Nos. 4,723,129 and 4,740,796. This scheme is applicable to both so-called on-demand-type and continuous-type apparatus. In the case of the on-demand type, at least one drive signal, which provides a sudden temperature rise that exceeds that for film boiling, is applied, in accordance with recording information, to an electrothermal transducer arranged to correspond to a sheet or fluid passageway holding a fluid (ink). As a result, thermal energy is produced in the electrothermal transducer to bring about film boiling on the thermal working surface of the recording head. Accordingly, air bubbles can be formed in the fluid (ink) in one-to-one correspondence with the drive signals. Owing to growth and contraction of the air bubbles, the fluid (ink) is jetted via the jetting port so as to form at least one droplet. If the drive signal has the form of a pulse, growth and contraction of the air bubbles can be made to take place rapidly and in appropriate fashion. This is preferred since it will be possible to achieve fluid (ink) jetting having excellent response.

Signals described in the specifications of U.S. Pat. Nos. 4,463,359 and 4,345,262 are suitable as drive pulses having this pulse shape. It should be noted that even better recording can be performed by employing the conditions described in the specification of U.S. Pat. No. 4,313,124, which discloses an invention relating to the rate of increase in the temperature of the above-mentioned thermal working surface.

In addition to the combination of the jetting port, fluid passageway and electrothermal transducer (in which the fluid passageway is linear or right-angled) disclosed as the construction of the recording head in each of the above-mentioned specifications, the present invention covers also an arrangement using the art described in the specifications of U.S. Pat. Nos. 4,558,333 and 4,459,600, which disclose elements disposed in an area in which the thermal working portion is curved. Further, it is permissible to adopt an arrangement based upon Japanese Patent Application Laid-Open No. 59-123670, which discloses a configuration having a common slot for the jetting portions of a plurality of electrothermal transducers, or Japanese Patent Application Laid-Open No. 59-138461, which discloses a configuration having openings made to correspond to the jetting portions, wherein the openings absorb pressure waves of thermal energy.

As a recording head of the full-line type having a length corresponding to the maximum width of the recording medium capable of being recorded on by the recording apparatus, use can be made of an arrangement in which the length is satisfied by a combination of plural recording heads of the kind disclosed in the foregoing specifications, or an arrangement in which recording heads serve a single integrally formed recording head.

Further, it is possible to use a freely exchangeable tip-type recording head attached to the main body of the apparatus and capable of being electrically connected to the main body of the apparatus and of supplying ink from the main body, or a cartridge-type recording head in which an ink tank is integrally provided on the recording head itself.

The addition of recovery means for the recording head and spare auxiliary means provided as components of the printing apparatus of the invention is desirable since these stabilize the effects of the invention greatly. Specific examples of these means that can be mentioned are capping means for capping the recording head, cleaning means, pressurizing or suction means, and preheating means such as an electrothermal transducer or another heating element or a combination thereof. Implementing a preliminary jetting mode for performing jetting separately of recording also is effective in order to perform stabilized printing.

The recording mode of the recording apparatus is not limited merely to a recording mode for a mainstream color only, such as the color black. The recording head can have a unitary construction or a plurality of recording heads can be combined. It is possible to use an apparatus having at least one recording mode for a plurality of different colors or for full-color recording using mixed colors.

Further, ink is described as being the fluid in the embodiment of the invention set forth above. The ink used may be one which solidifies at room temperature or lower, or one which softens of liquefies at room temperature. Alternatively, in an ink-jet arrangement, generally the ink is temperature-controlled by regulating the temperature of the ink itself within a temperature range of between 30° C. and 70° C. so that the viscosity of the ink will reside in a region that allows stable jetting of the ink. Therefore, it is permissible to use an ink liquefied when the recording signal is applied.

In order to positively prevent elevated temperature due to thermal energy when this is used as the energy for converting the ink from the solid state to the liquid state, or in order to prevent evaporation of the ink, it is permissible to use an ink which solidifies when left standing but which liquefies when heated. In any case, the present invention is applicable also in a case where use is made of an ink which solidifies in response to application of thermal energy, such as an ink solidified by application of thermal energy conforming to a recording signal or ink which has already begun to solidify at the moment it reaches the recording medium. Such inks may be used in a form in which they oppose the electrothermal transducer in a state in which they are held as a liquid or solid in the recesses or through-holes of a porous sheet, as described in Japanese Patent Application Laid-Open Nos. 54-56847 and 60-71260. In the present invention, the most effective method of dealing with these inks is the above-described method of film boiling.

As to the form of the ink-jet printing apparatus of the present invention, the apparatus may be provided integrally or separately as to an image output terminal of an image processing apparatus such as a computer. In addition, other configurations include a copying machine in combination with a reader or the like, a facsimile machine having a transmitting/receiving function, etc.

In accordance with the embodiment of the invention as described above, a printing system is constructed that is a combination of conventional printing such as roller printing and printing processing that relies upon a new printing method, namely the ink-jet method. As a result, the following effects are obtained:

(1) By using screen textile printing to print on a textile printing portion having the same uniform color, picture quality can be improved.

(2) It is possible to compensate for a decline in printed color density and insufficient dyeing in case of a cloth having a high ink absorbency or when dying is performed using a monochromatic ink, where the absolute amount of ink tends to be insufficient.

(3) Since the load of textile printing relying upon the ink-jet method can be alleviated, the service life of the ink-jet heads can be prolonged. As a result, it is possible to lower running cost. In addition, maintenance work such as head replacement is reduced correspondingly.

(4) By reducing the amount of ink jetted from the ink-jet heads, the amount of ink that attaches itself to the vicinity of the jetting ports also is reduced. This makes it possible to reduce the number of cleaning operations necessary for removing the attaching ink and, as a result, to raise the overall printing speed.

(5) The ink colors capable of being printed can be increased without changing the number of heads that perform ink-jet textile printing, and the types of colors produced by combining these ink colors can be increased by a wide margin.

Thus, in accordance with the present invention as described above, it is possible to provide a printing apparatus and method of a higher picture quality, in which improvements are made in terms of printing speed, maintenance and running cost.

As many apparently widely different embodiments of the present invention can be made without departing from the spirit and scope thereof, it is to be understood that the invention is not limited to the specific embodiments thereof except as defined in the appended claims.

What is claimed is:

1. A printing system for performing printing on a cloth, comprising:

printing means for printing a mark and a first image on the cloth by screen printing; and ink-jet print means for discharging a plurality of colors of ink from a plurality of ink-jet heads to print a second image on the first image on the cloth, said ink-jet print means comprising:

(i) conveying means for conveying the cloth in a predetermined direction;

(ii) scanning means for scanning the plurality of ink-jet heads substantially orthogonal to a direction in which the cloth is conveyed;

(iii) print control means for repeatedly controlling conveyance of the cloth by said conveying means and printing while scanning of the plurality of ink-jet heads by said scanning means so as to print an image on the cloth;

(iv) detecting means for detecting the mark printed by said printing means on the cloth while scanning of the plurality of ink-jet heads by said scanning means; and (v) start control means for controlling print start timing of each of the plurality of ink-jet heads, in a scanning direction of the ink-jet heads by said scanning means, based on a position of the mark detected by said detecting means, wherein said ink-jet print means prints the second image, in accordance with image data, on the cloth on which the first image has been printed.

2. The system according to claim 1, wherein printing of the first image by said printing means is performed on one side of the cloth and printing by said ink-jet print means is performed on a second side of the cloth.

3. The system according to claim 1, wherein said detecting means detects the mark in at least one direction of (i) a direction perpendicular to a feed direction of the cloth and (ii) the feed direction.

4. The system according to claim 1, wherein said detecting means uses a magnetic sensor that detects magnetic ink used to form the mark.

5. The system according to claim 1, wherein the mark is a mark indicating a position for printing a logo.

6. The system according to claim 1, wherein the mark is printed using ink inhibiting at least one of low light resistance, low water resistance, and low heat resistance.

7. A print method for printing a predetermined image on a cloth by screen printing means for printing by a screen printing method and ink-jet print means having a plurality of ink-jet heads, each of which ejects ink to print during scanning of the plurality of ink-jet heads, the method comprising:

a first printing step of printing a part of the predetermined image and a mark on the cloth by the screen printing means;

a conveyance step of conveying the cloth in a predetermined direction;

a scanning step of scanning the ink-jet heads in a direction different from a direction in which the cloth is conveyed; and a second printing step of repeating said conveyance step, and printing another part of the predetermined image on the cloth on which the part of the predetermined image has been printed in said first printing step, wherein, in said second printing step, the mark printed in said first printing step is detected and a print start timing of each of the plurality of ink-jet heads in a scanning direction of the ink-jet printing head is determined based on a position of the mark.

8. The method according to claim 7, further comprising a fixing step of fixing ink, which has been applied to the cloth at said second printing step, to the cloth.

9. The method according to claim 8, further comprising a washing step of applying a washing treatment to the cloth, which has been printed on, after said fixing step.

10. A print method for performing printing on a cloth by printing means for printing by using a screen plate and ink-jet print means having a plurality of ink-jet heads, each of which ejects ink to print while scanning the plurality of ink-jet heads, the method comprising the steps of:

printing a mark and a first image on the cloth by said printing means;

detecting the mark printed on the cloth while scanning of the plurality of ink-jet heads; and printing a second image on the cloth based on the position of the mark detected in said detecting step, by scanning the plurality of ink-jet heads substantially orthogonal to a direction in which the cloth is conveyed, and discharging a plurality of colors of ink from the plurality of ink-jet heads on the cloth, in accordance with image data corresponding to the second image, wherein, upon printing the second image, a printing timing of each of the plurality of ink-jet heads is controlled in a scanning direction of the ink-jet heads, based on a position of the mark detected in said detecting step, and the second image is printed, in accordance with image data, on the cloth on which the first image has been printed.

11. The method according to claim 10, further comprising a fixing step of fixing ink, which has been applied to the cloth, in said step of printing the second image, to the print medium.

12. The method according to claim 11, further comprising a washing step of applying a washing treatment to the cloth, which has been printed on, after said fixing step.

13. The method according to claim 12, wherein said washing step is for removing at least one of an unreacted dye and a substance used in pre-treatment.

14. The method according to claim 10, wherein said step of printing the mark is performed by using a different printing material than that used upon printing the first and second images.

15. The method according to claim 14, wherein in the mark printing step, the mark is printed using an ink exhibiting low heat resistance, said method further comprising a step of removing the mark by application of heat after the first and said second images are printed.

16. The method according to claim 14, wherein the mark is printed using an ink exhibiting very low light resistance, said method further comprising a step of removing the mark by irradiation with light after printing of the second image.

17. The method according to claim 10, wherein the cloth is wallpaper.

18. The method according to claim 9, wherein said washing step is for removing unreacted dye or a substance used in pre-treatment.

* * * * *

UNITED STATES PATENT AND TRADEMARK OFFICE

CERTIFICATE OF CORRECTION

PATENT NO. : 6,375,293 B1
DATED : April 23, 2002
INVENTOR(S) : Endo

It is certified that error appears in the above-identified patent and that said Letters Patent is hereby corrected as shown below:

Title page,
Item [56], References Cited, U.S. PATENT DOCUMENTS, the following should be inserted:

| | | | |
|---|---|---|---|
| -- 4,785,750 | 12/1988 | Best | 112/262.1 --; |
| 5,552,811 | 9/1996 | Kurata et al. | 347/28 --; |
| 4,783,220 | 11/1988 | Gamble et al. | 106/27 --; |
| 5,515,451 | 5/1996 | Tsuji et al. | 382/135 --; and |
| 4,799,068 | 1/1989 | Saito et al. | 346/1.1 --. |

FOREIGN PATENT DOCUMENTS,
"54056847" should read -- 54-56847 --;
"59101966" should read -- 59-101966 --;
"59123670" should read -- 59-123670 --;
"59138461" should read -- 59-138461 --;
"60071260" should read -- 60-71260 --;
"60145865" should read -- 60-145865 --;
"62087376" should read -- 62-87376 --;
"63172673" should read -- 63-172673 --; and
"116659" should read -- 1-16659 --.

Column 1,
Line 43, "example" should read -- examples --; and
Line 62, "a inks" should read -- inks --.

Column 3,
Lines 12, 18, 22 and 24, "of" should read -- to --; and
Lines 26, 28 and 30, "of" should read -- to --.

UNITED STATES PATENT AND TRADEMARK OFFICE

CERTIFICATE OF CORRECTION

PATENT NO. : 6,375,293 B1
DATED : April 23,2002
INVENTOR(S) : Endo

It is certified that error appears in the above-identified patent and that said Letters Patent is hereby corrected as shown below:

Column 14,
Line 64, “dying” should read -- dyeing --.

Signed and Sealed this

Twenty-first Day of January, 2003

JAMES E. ROGAN
*Director of the United States Patent and Trademark Office*